US009222444B2

(12) United States Patent
McLain

(10) Patent No.: US 9,222,444 B2
(45) Date of Patent: Dec. 29, 2015

(54) APPARATUS AND METHOD OF DETERMINING A LEAK CONDITION OF A FUEL SYSTEM

(71) Applicant: ALTe Powertrain Technologies, Inc., Auburn Hills, MI (US)

(72) Inventor: Kurt D. McLain, Clarkston, MI (US)

( * ) Notice: Subject to any disclaimer, the term of this patent is extended or adjusted under 35 U.S.C. 154(b) by 262 days.

(21) Appl. No.: 13/782,287

(22) Filed: Mar. 1, 2013

(65) Prior Publication Data

US 2013/0312713 A1 Nov. 28, 2013

Related U.S. Application Data

(60) Provisional application No. 61/650,345, filed on May 22, 2012.

(51) Int. Cl.
*F02M 25/08* (2006.01)
*F02D 33/00* (2006.01)

(52) U.S. Cl.
CPC ..... *F02M 25/08* (2013.01); *F02M 25/0809* (2013.01); *F02M 25/0818* (2013.01); *F02D 33/003* (2013.01)

(58) Field of Classification Search
CPC ..... F02M 25/08; F02M 25/0809; F02M 25/0818; F02M 37/0082; F02D 22/0033
USPC ..... 123/520, 516, 518, 519, 198 D; 73/1.58, 73/40, 45.3, 114.37
See application file for complete search history.

(56) References Cited

U.S. PATENT DOCUMENTS

| | | | | |
|---|---|---|---|---|
| 6,089,080 | A * | 7/2000 | Takaku et al. | 73/114.39 |
| 7,373,799 | B2 | 5/2008 | McLain et al. | |
| 7,866,356 | B2 * | 1/2011 | Benjey | 141/198 |
| 2006/0174698 | A1 * | 8/2006 | Chung et al. | 73/49.7 |
| 2011/0011472 | A1 | 1/2011 | McLain et al. | |
| 2011/0192220 | A1 | 8/2011 | Jackson et al. | |
| 2012/0097252 | A1 | 4/2012 | McLain et al. | |

* cited by examiner

*Primary Examiner* — Mahmoud Gimie

(57) ABSTRACT

A portion of a fuel system of a vehicle is disclosed. The vehicle includes a motor-generator-starter connected to an engine. The fuel system includes a fuel tank connected to the engine. The portion of the fuel system includes an evaporative emissions system and an evaporative emissions leak check system connected to the evaporative emissions system. The evaporative emissions leak check system includes a vacuum source. The vacuum source includes the motor-generator-starter connected to the engine. The motor-generator-starter actuates the engine when the vehicle is operated in a non-moving, keyed-off condition for creating a vacuum within an intake manifold of the engine. A method is also disclosed.

9 Claims, 3 Drawing Sheets

APPARATUS AND METHOD OF DETERMINING A LEAK CONDITION OF A FUEL SYSTEM

CROSS-REFERENCE TO RELATED APPLICATIONS

This U.S. patent application claims priority to U.S. Provisional Application 61/650,345 filed on May 22, 2012, the disclosure of which is considered part of the disclosure of this application and is hereby incorporated by reference in its entirety.

FIELD OF THE INVENTION

The disclosure relates to an apparatus and method of determining a leak condition of a fuel system.

DESCRIPTION OF THE RELATED ART

A contributing factor to poor air quality has been typically associated with the use of hydrocarbons, which are the basis for petroleum-based fuels that are burned by many automotive vehicles throughout the world. In the United States, air quality is regulated at the federal level by the Environmental Protection Agency (EPA) by way of the Clean Air Act of 1963. Additionally, at the state level, air quality is regulated by the California Air Resources Board (CARB), which operates as a department within the California Environmental Protection Agency (Cal/EPA), which is a cabinet-level agency within the government of the state of California.

Each of the EPA and CARB administer regulations requiring vehicle manufacturers to limit the amount of hydrocarbons that escape to atmosphere. Accordingly, there is a need in the art to improve vehicle design that will comply with regulations administered by one or both of the EPA and CARB.

SUMMARY

One aspect of the disclosure provides a portion of a fuel system of a vehicle. The vehicle includes a motor-generator-starter connected to an engine. The fuel system includes a fuel tank connected to the engine. The fuel system includes an evaporative emissions system and an evaporative emissions leak check system connected to the evaporative emissions system. The evaporative emissions leak check system includes a vacuum source. The vacuum source includes the motor-generator-starter connected to the engine. The motor-generator-starter actuates the engine when the vehicle is operated in a non-moving, keyed-off condition for creating a vacuum within an intake manifold of the engine.

In some examples, during the non-moving, keyed-off condition of the vehicle, the vacuum within the intake manifold of the engine is utilized by the evaporative emissions leak check system in order to perform a leak diagnostic in the evaporative emissions system.

In some implementations the fuel system includes a control module communicatively-coupled to each of the evaporative emissions system and the evaporative emissions leak check system.

In some examples, the evaporative emissions leak check system includes the control module being communicatively-coupled with: the engine, the motor-generator-starter, the purge valve, the two-position switch valve and the fuel tank pressure sensor.

In some implementations, upon a switch signal being sent from the control module to the two-position switch valve, the two-position switch valve is arranged in either: a closed orientation resulting in selective fluid decoupling of a canister from a filter by way of a fluid conduit, and an opened orientation resulting in selective fluid coupling of the canister to the filter by way of the fluid conduit.

In some examples, the evaporative emissions system includes: the canister, the purge valve fluidly-connected to the canister, and the two-position switch valve that is selectively fluidly-connected to the canister or the intake manifold of the engine.

In some implementations, the purge valve and the two-position switch valve are each communicatively-coupled to the control module.

In some examples, upon a purge signal being sent from the control module to the purge valve, the purge valve is changed in orientation from being in an initial closed orientation to an open orientation for permitting fuel vapor in the canister to be discharged into the engine.

In some implementations, upon a switch signal being sent from the control module to the two-position switch valve, the two-position switch valve is arranged in a closed orientation resulting in selective fluid decoupling of the canister from a filter for permitting a vacuum produced by the vacuum source to be exposed to the fuel tank, and, upon a vacuum containment signal being sent from the control module to the purge valve, the purge valve is changed in orientation from being in an initial open orientation to a closed orientation for permitting the vacuum produced by the vacuum source to be contained within the fuel tank.

In some examples, the evaporative emissions leak check system further includes: a fuel tank vacuum pressure sensor connected to the fuel tank.

In some implementations, the fuel tank vacuum pressure sensor is communicatively-coupled to the control module. The fuel tank vacuum pressure sensor obtains at least one vacuum pressure reading of the fuel tank that is sent to the control module. The control module utilizes the at least one vacuum pressure reading of the fuel tank for determining one of a leak condition and a no-leak condition of the fuel tank.

Another aspect of the disclosure provides a method including the step of: fluidly-connecting an evaporative emissions system to an evaporative emissions leak check system. The evaporative emissions leak check system includes a vacuum source. The vacuum source includes a motor-generator-starter connected to an engine. The motor-generator-starter actuates the engine when the vehicle is operated in a non-moving, keyed-off condition for creating a vacuum within an intake manifold of the engine. The method also includes the step of: during a non-moving, keyed-off operation of the vehicle, utilizing the vacuum within the intake manifold of the engine for performing a leak diagnostic in the evaporative emissions system.

In some examples, the method further includes the step of: communicatively-coupling a control module to each of the evaporative emissions system and the evaporative emissions leak check system.

In some implementations, the evaporative emissions system includes: a canister, a purge valve fluidly-connected to the canister, and a two-position switch valve fluidly-connected to the canister. The purge valve and the two-position switch valve are each communicatively-coupled to the control module. Upon sending a purge signal from the control module to the purge valve, the purge valve is changed in orientation from being in an initial closed orientation to an open orientation for permitting fuel vapor in the canister to be discharged into the engine.

In some examples, upon sending switch signal from the control module to the two-position switch valve, the two-position switch valve is arranged in a closed orientation resulting in selective fluid decoupling of the canister from a filter for permitting a vacuum produced by the vacuum source to be exposed to the fuel tank, and, upon: sending a vacuum containment signal being sent from the control module to the purge valve, the purge valve is changed in orientation from being in an initial open orientation to a closed orientation for permitting the vacuum produced by the vacuum source to be contained within the fuel tank.

In some implementations, the evaporative emissions leak check system further includes: a fuel tank vacuum pressure sensor connected to the fuel tank. The fuel tank vacuum pressure sensor is communicatively-coupled to the control module. Upon the fuel tank vacuum pressure sensor obtaining at least one vacuum pressure reading of the fuel tank that is sent to the control module, the control module utilizes the at least one vacuum pressure reading of the fuel tank for determining one of a leak condition and a no-leak condition of the fuel tank.

BRIEF DESCRIPTION OF THE DRAWINGS

The disclosure will now be described, by way of example, with reference to the accompanying drawings, in which.

DETAILED DESCRIPTION OF THE INVENTION

The Figures illustrate exemplary embodiment of an apparatus and method for determining a leak condition of a fuel system. Based on the foregoing, it is to be generally understood that the nomenclature used herein is simply for convenience and the terms used to describe the invention should be given the broadest meaning by one of ordinary skill in the art.

Figure 1A:
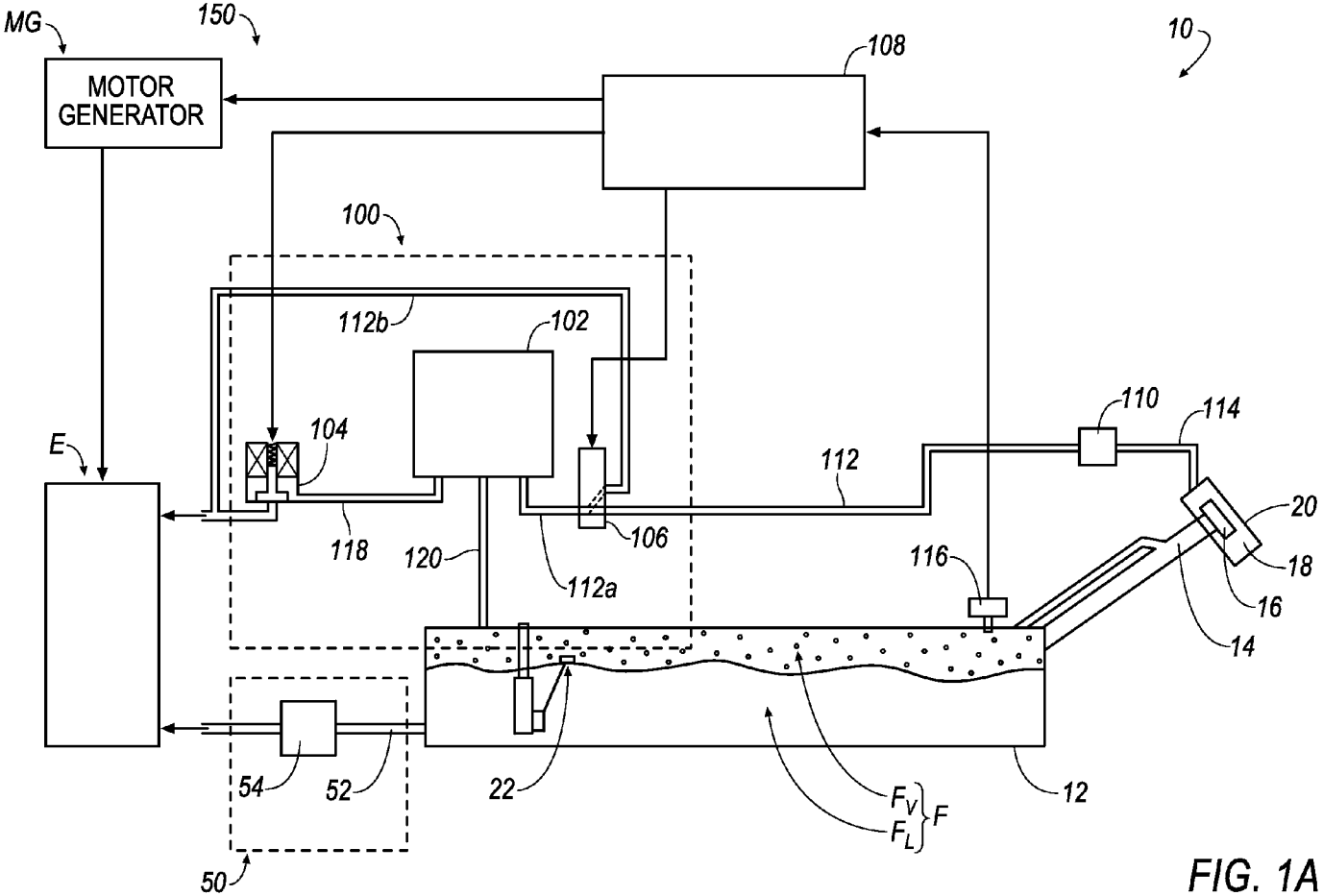
FIG. 1A is a view of an exemplary fuel circuit arranged in a first orientation.
Figure 1B:
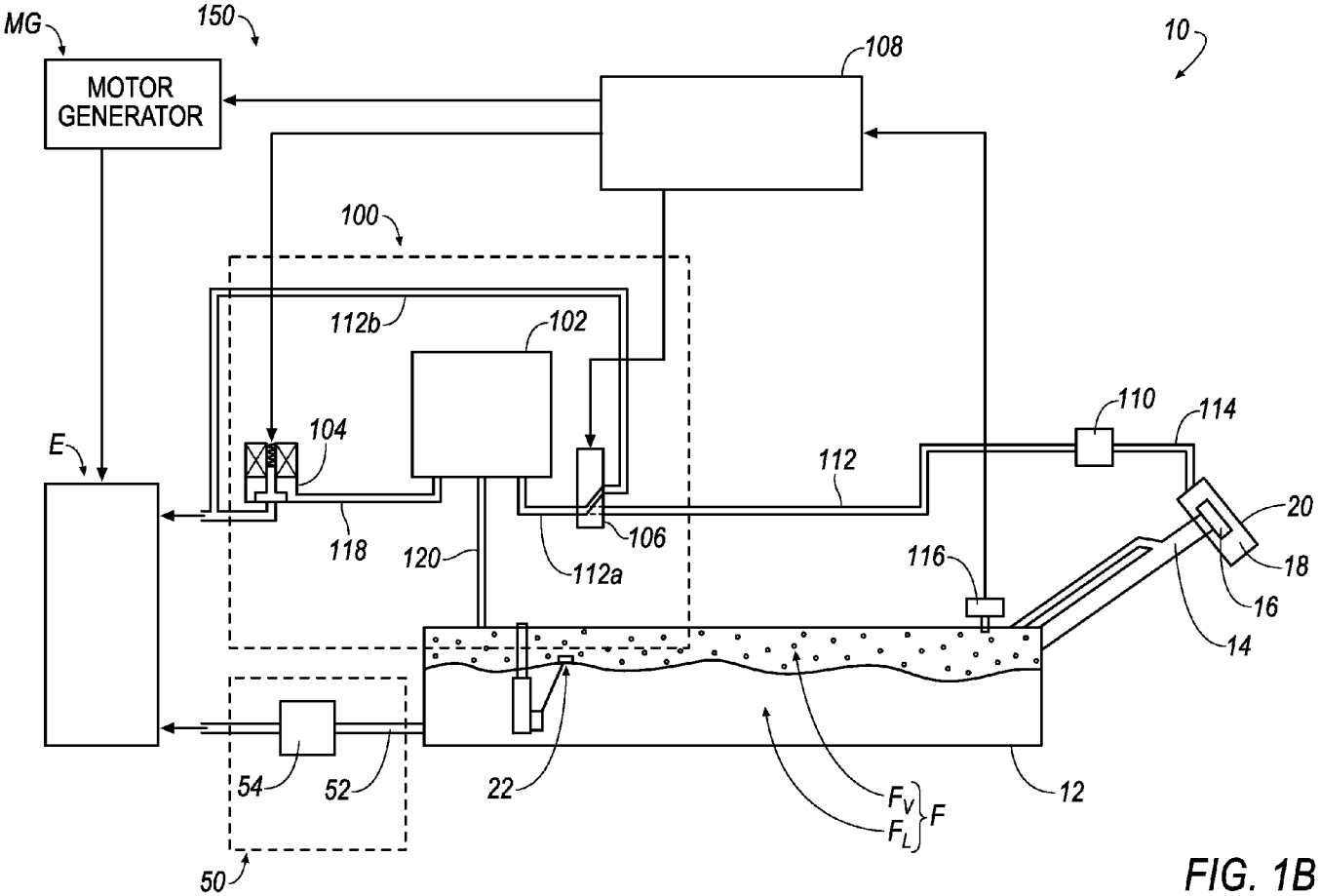
FIG. 1B is another view of the fuel circuit of FIG. 1A arranged in a second orientation.

Referring to FIGS. 1A-1B, a fuel system 10 including a fuel tank 12 is shown. Fuel, F, in liquid form (see, e.g., liquid fuel, $F_L$) may be deposited into the fuel tank 12 by way of an opening 14 formed by the fuel tank 12. A fuel cap 16 may be removably-attached to the fuel tank 12 for providing selective access to the opening 14. The fuel cap 16 may be arranged within a fueling compartment 18 formed by the fuel tank 12. A fuel door 20 may form a portion of an exterior body of a vehicle (not shown) and may be selectively arranged in an opened orientation or a closed orientation in order to provide selective access to the fueling compartment 18.

A fuel level sensor 22 may be arranged within the fuel tank 12 for measuring an amount of the liquid fuel, $F_L$, disposed within the fuel tank 12. The fuel level sensor 22 generates a fuel level signal that is displayed upon an instrument panel (not shown) of the vehicle. The amount of liquid fuel, $F_L$, disposed within the fuel tank 12 may be expressed in terms of, for example: a volume of the fuel tank 12, a percentage of a maximum volume of the fuel tank 12, or another suitable measure of the amount of liquid fuel, $F_L$, within the fuel tank 12.

In addition to liquid fuel, $F_L$, the fuel tank 12 may also contain vapor fuel, $F_V$. Environmental/ambient conditions relative to the fuel tank 12, such as, for example: one or more of a combination temperature, vibrations, and radiation may cause the liquid fuel, $F_L$, disposed within the fuel tank 12 to vaporize and thereby form the vapor fuel, $F_V$.

In addition to the fuel tank 12, the fuel system 10 also includes structure for connecting the fuel tank 12 to an engine, E, for the purpose of delivering the fuel, F, from the fuel tank 12 to the engine, E. As seen in FIGS. 1A-1B, the structure connecting the fuel tank 12 to the engine, E, may include a liquid fuel delivering sub-system, which is shown generally at 50. A portion of the structure forming the liquid fuel delivering sub-system 50 that delivers the liquid fuel, $F_L$, to the engine, E, may include, for example, a liquid fuel line conduit 52 and a fuel injector 54.

Figure 2:
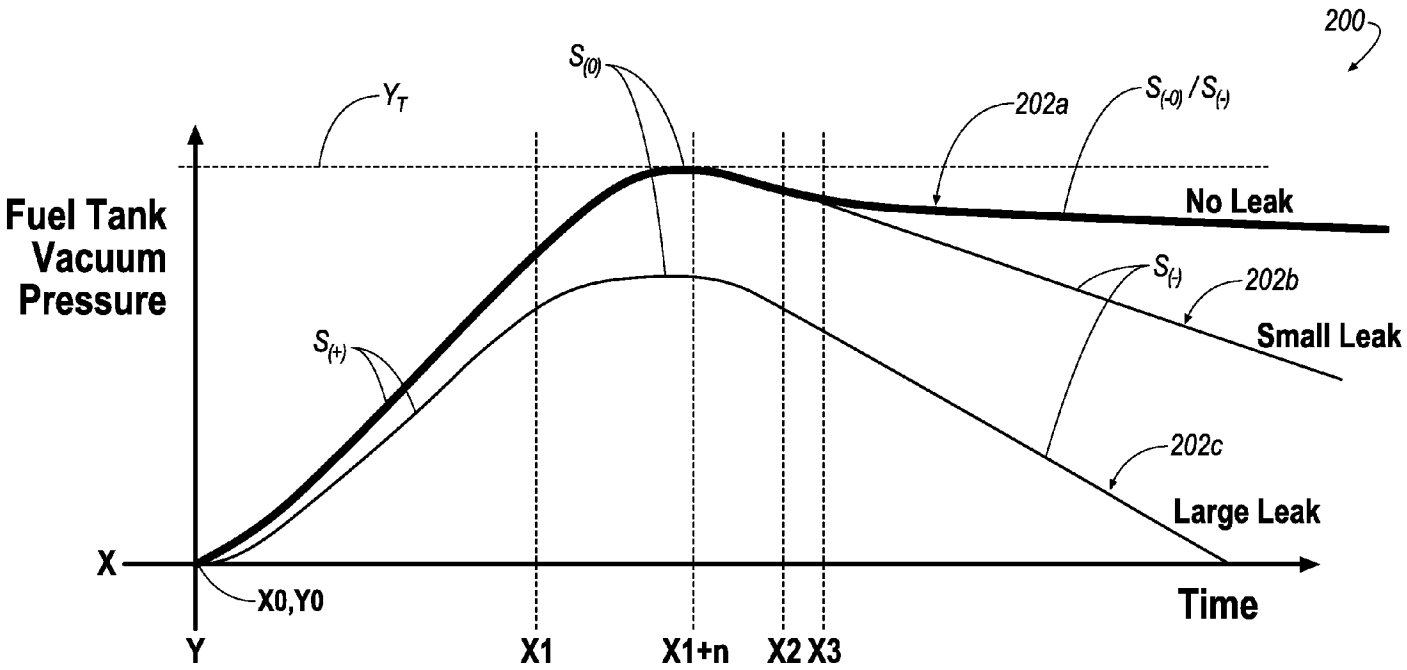
FIG. 2 is a view of an exemplary vacuum pressure decay signature graph.

Further, as seen in FIGS. 1A-2, the structure connecting the fuel tank 12 to the engine, E, may also include a vapor fuel delivering sub-system, which may be referred to as an evaporative emissions (EVAP) system 100. In an implementation, the EVAP system 100 may include: a canister 102, a purge valve 104 and a two-position switch valve 106. In some implementations, a control module 108 may be connected to one or both of the purge valve 104 and the two-position switch valve 106. Functionally, the EVAP system 100 may: (1) return vapor fuel, $F_V$, to the fuel tank 12, (2) trap and store the vapor fuel, $F_V$, within the canister 102 (e.g., the canister 102 may include one or more substances, such as, for example, charcoal that stores the vapor fuel, $F_V$), and (3) deliver the vapor fuel, $F_V$, from the canister 102 to the engine, E.

Once the fuel, F, is received by the engine, E, the engine, E, combusts a mixture of air and the fuel, F, within one or more cylinders (not shown) of the engine, E, in order to generate drive torque; the fuel, F, of the air-fuel mixture may be, for example, a combination of the liquid fuel, $F_L$, and the vapor fuel, $F_V$. In some vehicles, the drive torque generated by the engine, E, may be used to propel the vehicle; in such vehicles, the drive torque output by the engine, E, may be transferred to a transmission (not shown), and, the transmission may transfer the drive torque to one or more wheels (not shown) of the vehicle.

In other vehicles, such as, for example, hybrid vehicles, torque output by the engine, E, may not be transferred to the transmission. Instead, torque output by the engine, E, may be converted into electrical energy by, for example, a motor-generator-starter, MG, or a belt alternator starter (BAS) (not shown). The electrical energy may be provided to, for example: (1) the motor-generator-starter, MG, (2) another motor-generator-starter (not shown), (3) an electric motor (not shown), (4) an energy storage device (not shown), and/or a (5) starter (not shown). The electrical energy may be used to generate torque to propel the vehicle. Some hybrid vehicles may also receive electrical energy from an alternating current (AC) power source (not shown), such as, for example, a standard wall outlet; such hybrid vehicles may be referred to as plug-in hybrid vehicles. Accordingly, in some implementations, the fuel system 10 may supply fuel, F, to an engine, E, of a plug-in hybrid vehicle; in other implementations, the fuel system 10 may supply the liquid fuel, $F_L$, and the vapor fuel, $F_V$, to the engine, E. While some implementations of the fuel system 10 may be described as in the context of a plug-in hybrid vehicle, the present disclosure is also applicable to other types of vehicles having an internal combustion engine, E, and is not meant to be limited to a particular type of vehicle.

In an implementation, the EVAP system 100 may operate as follows. Depending on the keyed-on/keyed-off status of the vehicle including the EVAP system 100, the control module 108 may command: (1) the purge valve 104 to be in one of two positions being: an open position or a closed position, and (2) the two-position switch valve 106 to be arranged in a first ("opened") orientation shown in FIG. 1A for directly fluidly connecting fluid conduit 112 to a fluid conduit 112*a* extending from the canister 102 or a second ("closed") orientation shown in FIG. 1B for directly fluidly connecting the fluid conduit 112*a* extending from the canister 102 to a fluid conduit 112*b* extending from the engine, E, thereby permitting the intake manifold of the engine, E, to be in direct fluid communication with the fuel tank by way of the fluid conduits 112*a*, 112*b*, 120 and the canister 102 (noting that the fluid conduit 120 fluidly connects the canister 102 to the fuel tank 12). In an implementation, the purge valve 104 may be a solenoid valve. The control module 108 may enable the provision of ambient air (i.e., atmospheric air) to the canister 102 by actuating the two-position switch valve 106 to the position shown in FIG. 1A; when arranged in the position shown in FIG. 1A, the two-position switch valve 106 is in fluid communication with a filter 110 by way of the fluid conduit 112 connecting the two-position switch valve 106 to the filter 110.

While the two-position switch valve 106 is in the position shown in FIG. 1A, the control module 108 may actuate the purge valve 104 (i.e., for changing the orientation of the purge valve 104 from a closed orientation to the open orientation) in order to purge vapor fuel, $F_V$, that is stored within the canister 102 to the intake manifold of the engine, E. Actuation of the purge valve 104 by the control module 108 may be conducted on a selectively-programmed basis; for example, the control module 108 may control the rate (i.e., a "purge rate") at which vapor fuel, $F_V$, is purged from the canister 102 to the engine, E. In an implementation, the control module 108 may control the purge rate by controlling a duty cycle of a signal applied to the purge valve 104. Upon arranging the purge valve 104 in an open orientation, the vacuum within the intake manifold of the engine, E, then draws vapor fuel, $F_V$, from the canister 102 through the purge valve 104 and to the intake manifold of the engine, E. In other implementations, the purge rate may be determined based on not only the duty cycle of the signal applied to the purge valve 104, but also, a determined/detected amount of vapor fuel, $F_V$, within the canister 102, which may be detected by a sensor (not shown) that is connected to the canister 102, which may be communicatively-coupled to the control module 108.

When the purge valve 104 is returned to a closed orientation, and, when the two-position switch valve 106 is maintained in the orientation of FIG. 1A, ambient air may be provided to the canister 102 through the fluid conduit 112 (i.e., the ambient air may be drawn from, for example, the fueling compartment 18 by way of a fluid conduit 114 connecting the fueling compartment 18 to an "unfiltered air side" of the filter 110 and also by way of the fluid conduit 112 (extending from a "filtered air side" of the filter 110). Functionally, the filter 110 receives unfiltered ambient air from the fluid conduit 114 and expels filtered air into the fluid conduit 112 by filtering various particulates from the incoming ambient air from the fluid conduit 114. In some implementations, the filter 110 may filter particulates having a dimension of more than a predetermined dimension, such as, for example, a dimension greater than approximately about 5 microns.

When not in use, the two position switch valve 106 is arranged in an open orientation as seen in FIG. 1A and the purge valve 104 is arranged in a closed orientation. Once the vehicle has been shut down or keyed-off, the EVAP system 100 may be subjected to an EVAP leak check (ELC) that determines if there is or is not one or more fuel leaks (in the form of, e.g., liquid fuel, $F_L$, leaks and/or vapor fuel, $F_V$, leaks) in the EVAP system 100 and/or the fuel tank 12. In some implementations, an ELC may be conducted as a result of the control module 108 communicating with: the engine, E, the motor-generator-starter, MG, the purge valve 104, the two-position switch valve 106 and a fuel tank pressure sensor 116 directly connected to the fuel tank 12 for directly sensing a vacuum pressure within the fuel tank 12; as a result, collectively, the control module 108, the engine, E, the motor-generator-starter, MG, the purge valve 104, the two-position switch valve 106 and the fuel tank pressure sensor 116 may be referred to as an ELC system 150 as a result of the control module 108 being communicatively coupled to all of: the engine, E, the motor-generator-starter, MG, the purge valve 104, the two-position switch valve 106 and the fuel tank pressure sensor 116. In some implementations, an ELC may be conducted by the ELC system 150 in order to perform a leak check once the vehicle is: (1) driven a predetermined distance (e.g., at least approximately about one mile) and (2) after a vehicle has been shut down or keyed-off for a predetermined amount of time (e.g., approximately about six-to-nine hours). When a vehicle is shut down, the control module 108 is normally in a "sleep mode" such that the control module 108 has no external communication and operates on low power. Just prior to conducting a leak check, the control module 108 switches from the "sleep mode" to a "wake mode" in which the control module 108 has external communication and operates on full power. In some implementations, the system may include a safety disablement feature in order to prevent the engine, E, from turning in some situations (e.g., when the vehicle is being serviced). In an example, the safety disablement feature may include a methodology including the steps of: upon pivoting a hood (not shown) of the vehicle from a closed orientation to an open orientation in order to expose the engine compartment, a signal (not shown) may be communicated to the control module 108 which will prevent the engine, E, from turning.

When the control module 108 initiates a leak check, the control module 108 sends a signal to the two-position switch valve 106 in order to cause the two-position switch valve 106 to change in orientation from the position of FIG. 1A to a position shown in FIG. 1B in order to: (1) fluidly disconnect the fluid conduit 112 from the fluid conduit 112*a* extending from the canister 102 such that (2) the fluid conduit 112*a* extending from the canister is connected to the fluid conduit 112*b* extending from the intake manifold of the engine, E; when the two-position switch valve 106 is arranged as shown in FIG. 1B, the control module 108 may also send a signal to the purge valve 104 for arranging the purge valve 104 in a closed orientation. Then, the control module 108 may send a signal to the motor generator-starter, MG, in order to cause the engine, E, to create a vacuum within the intake manifold when the vehicle is the keyed-off orientation such that the motor-generator-starter, MG, in combination with the engine, E, may be collectively referred to as a vacuum source that creates a vacuum (within the intake manifold of the engine, E) that is utilized for conducting the leak check of the EVAP system 100 (e.g., the vacuum within the intake manifold of the engine, E, may be exposed to the fuel tank 12 by way of the fluid conduits 112*a*, 112*b*, 120).

Upon exposing the fuel tank 12 to the vacuum (as a result of the vacuum being exposed to: (1) firstly, the fluid conduit 112*b* connected to the intake manifold of the engine, E, then (2) the fluid conduit 112*a* by way of the two-position switch valve 106 connecting the fluid conduits 112*a*, 112*b*, then (3) the canister 102 that is connected to the fluid conduit 112*a*, then (4) the fluid conduit 120 that is connected to the canister 102, then (5) the fuel tank 12 connected to the fluid conduit 120), the control module 108 may receive one or more vacuum pressure readings from the fuel tank vacuum pressure sensor 116. Referring to FIG. 2, an implementation for determining a leak condition of the fuel system 10 is described as follows. As seen in FIG. 2, a vacuum pressure decay signature graph 200 is shown. The graph 200 includes an X-axis and a Y-axis. The X-axis is represented by units of time and the Y-axis is represented by a fuel tank vacuum pressure reading from the fuel tank vacuum pressure sensor 116. The origin (i.e., X0, Y0) of the vacuum pressure decay signature graph 200 is related to, for example: the time (i.e., X0) immediately before the vacuum of the intake manifold of the engine, E, is exposed to the fuel tank 12 and vacuum pressure (i.e., Y0) of the fuel tank 12 immediately before the vacuum of the intake manifold of the engine, E, is exposed to the fuel tank 12.

As represented by the curves 202*a*, 202*b*, 202*c* on the vacuum pressure decay signature graph 200, just after exposing the fuel tank 12 to the vacuum of the intake manifold of the engine, E, at time, X0, each of the curves 202*a*, 202*b*, 202*c* are defined by a first, positive slope portion, $S_{(+)}$, indicating an increase in vacuum pressure, Y, within the fuel tank 12. Then, as seen in the vacuum pressure decay signature graph 200, during a period of time between about the time X1 and X2, each of the curves 202*a*, 202*b*, 202*c* transitions from the first, positive slope, $S_{(+)}$, to substantially a zero or no-slope portion, $S_{(0)}$, indicating that the vacuum pressure, Y, within the fuel tank 12 has peaked/is about to stabilize/is stabilizing/has stabilized. Then, as seen in the vacuum pressure decay signature graph 200, after time X2, each of the curves 202*a*, 202*b*, 202*c* transitions from the substantially zero or no-slope portion, $S_{(0)}$, to a second, negative slope $S_{(-)}$, or substantially zero (but negative) slope portion, $S_{(-0)}$ (see curve 202*a*) indicating a decay or decrease in vacuum pressure, Y, within the fuel tank 12.

At a time X1+n, which occurs after time X1 and before time X2, the control module 108 sends a signal to the two-position switch valve 106 for arranging the two-position switch 106 in an orientation shown in FIG. 1A (while the purge valve 104 remains closed). When the two-position switch valve is arranged as shown in FIG. 1A (while the purge valve 104 remains closed), further application of the vacuum from the intake manifold of the engine, E, to the fuel tank 12 is ceased due to the fact that the intake manifold of the engine, E, (and vacuum originating therefrom) is fluidly disconnected from the fuel tank 12. Therefore, the previously-applied vacuum (from time X0 to time X1+n) from the intake manifold of the engine, E, is contained within the fuel tank 12.

Starting at the time X0, the fuel tank vacuum pressure sensor 116 may continuously or periodically sends a vacuum pressure reading, Y, of the fuel tank 12 to control module 108. The control module 108 may include logic that interprets the vacuum pressure reading, Y, in order to determine if there is a leak condition in the EVAP system 100.

In an implementation, the control module 108 may determine a leak condition or a no-leak condition, as follows. Firstly, the control module 108 may be provided with/programmed with a fuel tank vacuum pressure threshold value, $Y_T$. At the time, X1+n (i.e., when the vacuum originating from the intake manifold of the engine, E, is fluidly disconnected from the fuel tank 12), the control module 108 may determine if the vacuum pressure reading, Y, is equal to or approximately equal to the fuel tank vacuum pressure threshold value, $Y_T$. If the control module 108 determines that the vacuum pressure reading, Y (see curve 202*c*), is not equal to the fuel tank vacuum pressure threshold value, $Y_T$, at time, X1+n, the control module 108 will diagnose a leak condition in the EVAP system 100. In some implementations, the control module 108 will continue to receive one or more vacuum pressure reading(s) from the fuel tank vacuum pressure sensor 116 after diagnosing a leak condition at time, X1+n, and, depending on the rate of decay of the vacuum pressure reading, Y, after time, X1+n, the control module 108 may determine that the leak condition in the EVAP system 100 is a "large leak condition" (i.e., a large leak condition may be equivalent to an opening in the EVAP system 100 that is approximately equal to about 0.040". However, if the control module 108 determines that the vacuum pressure reading, Y (see curves 202*a*, 202*b*), is approximately equal to the fuel tank vacuum pressure threshold value, $Y_T$, at the time, X1+n, the control module 108 will not yet diagnose a leak condition or a no-leak condition in the EVAP system 100 and will continue to receive one or more vacuum pressure reading(s) from the fuel tank vacuum pressure sensor 116.

After time X1+n and before time X3, the control module 108 continues to receive one or more vacuum pressure reading(s) from the fuel tank vacuum pressure sensor 116 and should expect a rate of decay of the vacuum pressure reading, Y, after time, X1+n. After time X3, if the control module 108 determines that that rate of decay of the vacuum pressure reading, Y, has substantially stabilized (i.e., the negative slope $S_{(-)}$, of the vacuum pressure reading, Y, remains substantially about the same, or deviates to a substantially zero but negative slope, $S_{(-0)}$ (see curve 202*a*), the control module 108 will diagnose a "no leak condition" of the EVAP system 100. However, after time X3, if the control module 108 determines that that rate of decay of the vacuum pressure reading, Y, continues (i.e., the negative slope $S_{(-)}$, of the vacuum pressure reading, Y, remains about the same (see curve 202*b*)), the control module 108 may determine that a leak condition in the EVAP system 100; in an implementation, a leak condition determined after time, X3, as described above may be referred to as a "small leak condition" (i.e., a small leak condition may be equivalent to an opening in the EVAP system 100 that is approximately equal to about 0.020".

If a small leak condition or a large leak condition is detected in the fuel system 10, the determined leak condition may be stored by the control module 108. Upon keying-on the vehicle, the control module 108 may send an activation signal for activating, for example, an indicator associated with an instrument panel of the vehicle. The indicator may include, for example, a visible and/or audible indicator informing the vehicle operator that the vehicle needs to be serviced. In some implementations, the indicator may inform the vehicle operator of the detected leak condition, or, alternatively, the indicator may broadly indicate that the vehicle needs a form of service; upon a service technician examining/communicating with the vehicle (by way of, for example, connecting a vehicle service diagnostic device or computer to the control module 108), the service technician may be made aware of the determined leak condition when the vehicle was in the keyed-off condition. The service technician may then address the leak by way of replacing/repairing once or more of the components of the fuel system 10.

As used above, the terms "module," "control module" or "controller" may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The terms "module," "control module" or "controller" may include memory (shared, dedicated, or group) that stores code executed by the processor. The term "code," as used above, may include software, firmware, and/or microcode, and may refer to programs, routines, functions, classes, and/or objects. The term "shared," as used above, means that some or all code from multiple modules may be executed using a single (shared) processor. In addition, some or all code from multiple modules may be stored by a single (shared) memory. The term "group," as used above, means that some or all code from a single module may be executed using a group of processors. In addition, some or all code from a single module may be stored using a group of memories. The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A portion of a fuel system of a vehicle, wherein the vehicle includes a motor-generator-starter connected to an engine, wherein the fuel system includes a fuel tank connected to the engine, comprising:

an evaporative emissions system having:

a canister, a purge valve fluidly-connected to the canister, a fuel tank vacuum pressure sensor connected to the fuel tank, and a two-position switch valve that is selectively fluidly connected to the canister or the intake manifold of the engine; and an evaporative emissions leak check system connected to the evaporative emissions system, wherein the evaporative emissions leak check system includes:

a vacuum source, wherein the vacuum source includes: the motor-generator-starter connected to the engine, wherein the motor-generator-starter actuates the engine when the vehicle is operated in a non-moving, keyed-off condition for creating a vacuum within an intake manifold of the engine.

2. The portion of the fuel system according to claim 1, wherein, during the non-moving, keyed-off condition of the vehicle, the vacuum within the intake manifold of the engine is utilized by the evaporative emissions leak check system in order to perform a leak diagnostic in the evaporative emissions system.

3. The portion of the fuel system according to claim 1, further comprising:

a control module communicatively-coupled to each of the evaporative emissions system and the evaporative emissions leak check system.

4. The portion of the fuel system according to claim 3, wherein the evaporative emissions leak check system includes the control module being communicatively-coupled with: the engine, the motor-generator-starter, the purge valve, the two-position switch valve and the fuel tank pressure sensor.

5. The portion of the fuel system according to claim 4, wherein, upon a switch signal being sent from the control module to the two-position switch valve, the two-position switch valve is arranged in either:

a closed orientation resulting in selective fluid decoupling of the canister from a filter by way of a fluid conduit, and an opened orientation resulting in selective fluid coupling of the canister to the filter by way of the fluid conduit.

6. The portion of the fuel system according to claim 4, wherein the purge valve and the two-position switch valve are each communicatively-coupled to the control module.

7. The portion of the fuel system according to claim 6, wherein, upon a purge signal being sent from the control module to the purge valve, the purge valve is changed in orientation from being in an initial closed orientation to an open orientation for permitting fuel vapor in the canister to be discharged into the engine.

8. The portion of the fuel system according to claim 6, wherein, upon a switch signal being sent from the control module to the two-position switch valve, the two-position switch valve is arranged in a closed orientation resulting in selective fluid decoupling of the canister from a filter for permitting a vacuum produced by the vacuum source to be exposed to the fuel tank, and wherein, upon a vacuum containment signal being sent from the control module to the purge valve, the purge valve is changed in orientation from being in an initial open orientation to a closed orientation for permitting the vacuum produced by the vacuum source to be contained within the fuel tank.

9. The portion of the fuel system according to claim 8, wherein the fuel tank vacuum pressure sensor is communicatively-coupled to the control module, wherein the fuel tank vacuum pressure sensor obtains at least one vacuum pressure reading of the fuel tank that is sent to the control module, wherein the control module utilizes the at least one vacuum pressure reading of the fuel tank for determining one of a leak condition and a no-leak condition of the fuel tank.

* * * * *